US005440361A

United States Patent [19]

Moortgat

[11] Patent Number: 5,440,361

[45] Date of Patent: Aug. 8, 1995

[54] METHOD FOR FLATTENING ACETATE-BASED FILMS USING STEAM

[75] Inventor: Ronald A. Moortgat, Chatsworth, Calif.

[73] Assignee: The Walt Disney Company, Burbank, Calif.

[21] Appl. No.: 116,728

[22] Filed: Sep. 3, 1993

[51] Int. Cl.[6] ..... G03D 15/08

[52] U.S. Cl. ..... 352/56; 354/354

[58] Field of Search ..... 360/134, 131; 428/692, 428/694 R; 156/389; 352/56, 244; 354/354

[56] References Cited

U.S. PATENT DOCUMENTS

| | | | |
|---|---|---|---|
| 1,543,301 | 6/1925 | Stock | 352/56 |
| 1,783,895 | 12/1930 | Wright | 352/56 |
| 2,011,576 | 8/1935 | Gage | 352/56 |
| 2,275,139 | 3/1942 | Gage | 352/56 |
| 2,782,697 | 2/1957 | Krupa | 354/354 |
| 3,687,710 | 8/1972 | Bunchez | 430/401 |
| 3,967,025 | 6/1976 | Tanabe et al. | 360/134 X |
| 4,109,287 | 8/1978 | Kawai et al. | 360/131 |
| 4,274,731 | 6/1981 | Carter et al. | 355/30 |
| 4,370,408 | 1/1983 | Kiening | 430/432 |
| 4,535,224 | 8/1985 | Westman, Jr. | 219/373 |

FOREIGN PATENT DOCUMENTS

| | | |
|---|---|---|
| 58-55221 | 4/1983 | Japan . |
| 61-113134 | 5/1986 | Japan . |
| 05124099 | 5/1993 | Japan . |

*Primary Examiner*—Aristotelis Psitos
*Assistant Examiner*—James L. Habermehl
*Attorney, Agent, or Firm*—Pretty, Schroeder, Brueggemann & Clark

[57] ABSTRACT

A method for treating acetate-based films, particularly those having a magnetic particle layer onto which a sound track has been recorded, so that information recorded on the film can be reproduced even when the film has been distorted by heat or humidity. The film is placed in a container where it contacts a sufficient amount of steam until the film absorbs sufficient moisture from the steam so that it softens and becomes sufficiently flat to provide good contact with a playback head. Preferably, the film contacts the steam for about 10 to about 20 seconds and, in particular, about 15 seconds.

22 Claims, 1 Drawing Sheet

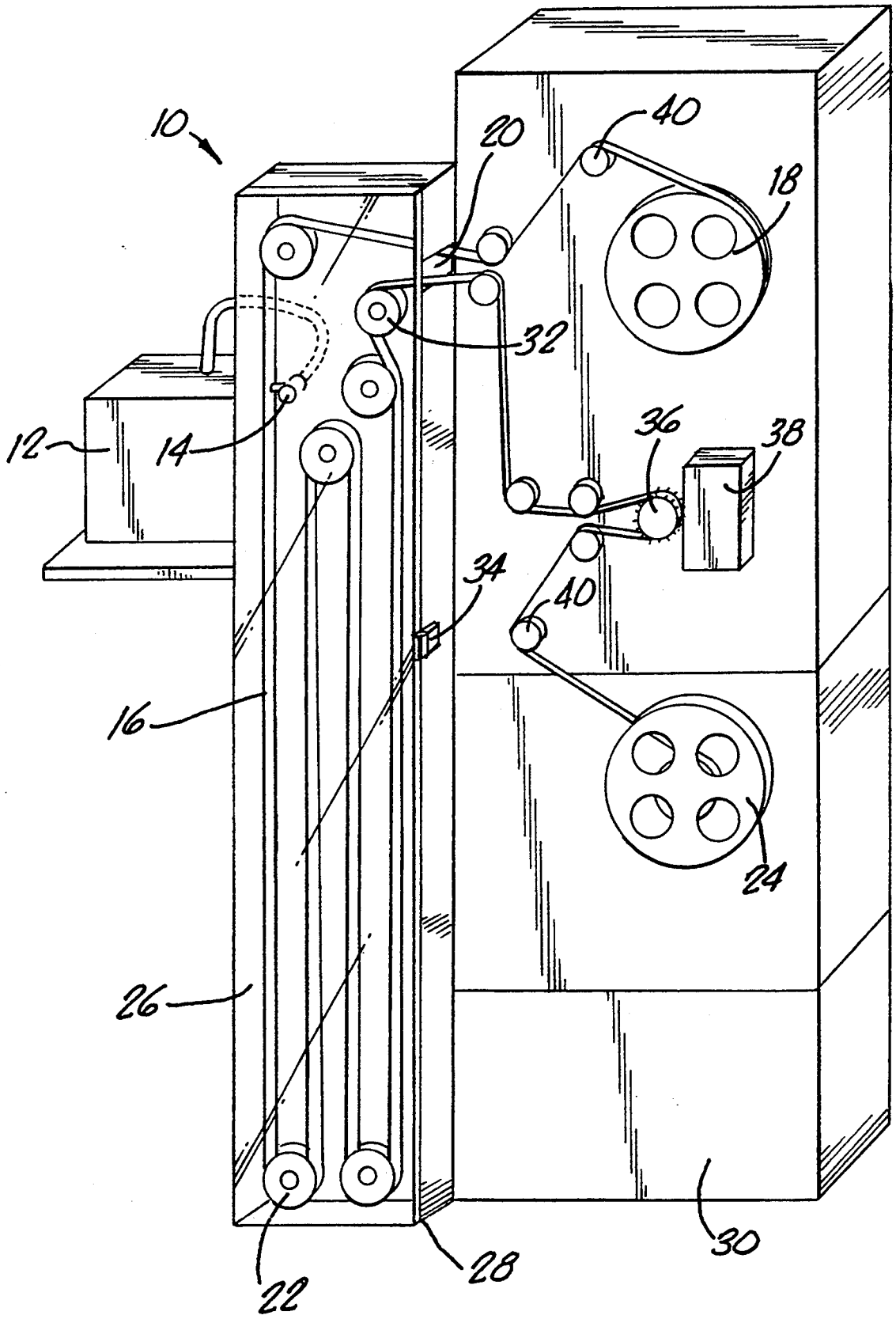
10
20
40
18
32
12
14
36
38
34
40
16
24
26
22
28
30

METHOD FOR FLATTENING ACETATE-BASED FILMS USING STEAM

BACKGROUND OF THE INVENTION

1. Field of the Invention

The present invention relates to a process for treating acetate-based films, particularly those having a magnetic particle layer onto which a sound track has been recorded, so that information recorded on the film can be reproduced.

2. Description of Related Art

Traditionally, the motion picture industry has prepared and stored picture and sound masters separately until a composite print is made for release. Beginning in the early 1950's, sound masters for recording the sound tracks to motion pictures were made on acetate-based films having a layer of magnetic particles adhered thereto by a binder (hereinafter referred to as "magnetic acetate-based film"). The magnetic particle layer allows the sound track to be edited, erased, or recorded over as the sound track is produced. In addition, whenever a reproduction of the sound track is desired, the sound master is run through, e.g., a magnetic reproducer, referred to more generally herein as a "sound transfer device," which reproduces the sound track(s). Currently, up to six channels of recorded information may be present on a sound master, and all must have intimate contact with the playback head to insure that the reproduction will faithfully reproduce all of the frequencies on the sound master.

Today, it is well known that acetate-based films should be stored in a cool and dry environment, preferably at a temperature from about 50° to 60° F. and a relative humidity of less than about 50 percent. However, when magnetic acetate-based films first began to be used, this was not well understood, nor was it appreciated what effect the passage of time had on the film's physical properties if the film was not stored properly. For example, acetate-based films are now known to have an affinity for water, which may cause them to distort if they are not stored under proper conditions. Consequently, adequate care often was not taken to ensure that acetate-based films were stored under conditions that would enable the information recorded on the film to be reproduced years later.

Many rolls of magnetic acetate-based film still in existence today cannot be put through a sound transfer device satisfactorily because of warpage caused by dehydration or temperature instability due to improper storage. This warpage may take the form of "cupping" or "curling," sometimes also referred to as "crowning," or it may be longitudinal warpage. These types of physical distortion interfere with obtaining the required intimate contact between the playback head and the surface of the film contacting the playback head. Moreover, exposure of acetate-based films to either heat or humidity tends to accelerate the deterioration process, and once this deterioration starts, there is no method currently known to slow it down or stop it before the acetate layer ultimately deteriorates.

A related problem with magnetic acetate-based films that have not been properly stored is that such films may have deteriorated to the point where the binder that adheres the magnetic particle layer to the acetate layer no longer performs this function adequately. This means that the magnetic particle layer begins to separate from the acetate layer, leaving a pile of magnetic particles at the bottom of the film container. Such films are unstable and difficult to handle, and if too much of the magnetic layer is lost, the information recorded thereon is also lost. The unpredictability of such binders also makes the use of chemical reagents for flattening the film particularly undesirable.

Prior to the present invention, the only way that sound tracks recorded on a physically distorted magnetic acetate-based film could be reproduced was to contact the film with a "pressure pad" at the point where the film passes over the playback head in a sound transfer device. A steady pressure would then be applied to the pressure pad to force the film to conform to the contours of the playback head as the film passed over the head. The application of sufficient pressure to a film that is not excessively physically distorted will cause the film to conform better to the contour of the playback head, and an acceptable, albeit sometimes marginal, reproduction can be produced by this prior art method. This method also allows the sound track to be transferred to another, preferably more stable substrate, such as a polyester film, that is known to be non-reactive with water when stored at room temperature. Care must be taken, however, not to apply too much pressure, as that can distort the true film path and can also cause vibrations of the film that will modulate the recorded sound, thus making the reproduction useless. Also, in those instances where the acetate-based film has become severely cupped or curled, it has not been possible to apply sufficient pressure without causing these types of undesirable consequences. Since the necessary intimate contact between the film and the playback head cannot be obtained in such instances, an excessively physically distorted sound master has been virtually useless. This means that prior to the present invention, the information recorded on such sound masters was lost forever.

Accordingly, the need exists for a method of treating acetate-based films, particularly acetate-based films having a magnetic particle layer onto which a sound track is recorded, so that information recorded on such films can be reproduced even when a film has been distorted by heat or humidity, or both.

SUMMARY OF THE INVENTION

The present invention solves the problem of reproducing information recorded on an acetate-based film that has been physically distorted by exposure to heat or humidity or otherwise caused to distort. The process of the present invention goes against conventional wisdom in the art in that it treats acetate-based films by exposing the film to heat and moisture. Thus, the very conditions that tend to accelerate the decomposition of such acetate-based films are used to restore them, at least temporarily, to a physical state that permits retrieval and reproduction of information recorded on the film to be made.

The present invention provides a process for treating an acetate-based film, such as those having a magnetic particle layer onto which a sound track has been recorded, by placing the film in a container and contacting the film with steam until the film absorbs sufficient moisture from the steam to soften the acetate layer. As the acetate layer softens, it "relaxes" and becomes flatter. In this context, "relaxes" means that the acetate layer becomes more supple, which decreases the amount of distortion in the film due to cupping or curling.

Preferably, the acetate-based film is introduced into a chamber in which it passes over and around a plurality of rollers while steam is introduced into the chamber. The steam contacts the film as it passes through the chamber for a period of time sufficient for the film to become softer, so that the acetate layer relaxes and the film becomes flatter. If necessary, the film may be repeatedly passed through the steam-filled chamber at a controlled speed until the desired amount of flattening occurs.

Generally, contacting the film with steam for about 10 to about 20 seconds, preferably about 15 seconds, provides enough time for the film to absorb sufficient moisture so that it softens and the acetate layer relaxes. Extreme care must be taken, however, to ensure the film is not exposed to the steam for much more than this time, e.g., more than about 30 seconds at any one time. Extended exposure of an acetate-based film to the steam, depending upon its age, brittleness, and overall physical condition, may cause the film to absorb too much moisture and become so soft as to become "mushy." When this happens, the film loses its dimensional properties and cannot be put through a sound transfer device. This means that the film must be discarded, and the information recorded on the film is lost forever.

Any misalignment of the rollers over which the film passes in the chamber, or after leaving the chamber, can cause the softened film to deviate from its intended path, which can damage the film. To minimize the possibility of such misalignments, the speed of the film passing through the chamber is carefully controlled. As a general rule, the slower the film speed, the less chance there is that a misalignment will cause a problem. Although the film passing through the chamber may travel at the customary running speed of 90 feet per minute, preferably the film travels at a speed of about 45 feet per minute or less.

After the film is removed from the chamber, the information recorded on the film can be reproduced by passing the film through a sound transfer device. Because the film has been made flatter by the process of the present invention, there is better contact between the film and the playback head. As a result, the information recorded on the film, such as a sound track, can be transferred onto a better mastering stock, preferably a more durable substrate, such as a polyester film.

Other features and advantages of the present invention will become apparent from the following detailed description of the preferred embodiment, which illustrates by way of example the principles of the invention.

BRIEF DESCRIPTION OF THE DRAWINGS

FIG. 1 a perspective view showing the principal elements of a preferred embodiment of a steam chamber according to the present invention and a mechanical film transporter for transporting the film over and around a plurality of rollers arranged for passing film through the chamber.

DETAILED DESCRIPTION OF THE PREFERRED EMBODIMENT

Turning now to the drawing, FIG. 1 shows a chamber 10 into which steam from a suitable source, such as vaporizer 12, is introduced through nozzle 14. A magnetic acetate-based film 16 on supply reel 18 mounted on a mechanical film transporter 30 enters the chamber through slot 20 and passes over and around a plurality of film rollers 22 until the film 16 exits through slot 20 and is rewound on take-up reel 24 mounted on the mechanical film transporter 30 and driven by a motor (not shown). The mechanical film transporter 30 also includes conventional guide rollers 40 for guiding the film 16 before it enters and after it leaves chamber 10.

As the film 16 passes through the chamber 10, it contacts the steam introduced through nozzle 14. As the steam contacts the film, moisture from the steam is absorbed by the film, the amount of moisture absorbed and the rate at which the moisture is absorbed being dependent upon the physical condition of the film, e.g., its age, brittleness, acetate content, etc. As the film absorbs this moisture, it softens such that the acetate layer "relaxes," making the film flatter. Steam also condenses on the film's surface. Thus, when the film exits the chamber, this moisture remains on the film's surface. Allowing any foreign matter to be present on the surface of a film is considered to be contrary to good practice in the art as it conceivably could interfere with obtaining the necessary intimate contact between the film and a playback head. Consequently, this moisture must be removed before the film passes over the playback head. One way that the moisture may be removed is by wiping the film, but care must be taken not to damage the film when wiping, particularly since the film tends to be much softer upon exiting the chamber. For that reason, it is preferred to let the film dry naturally by allowing the moisture to evaporate. Since the moisture that condenses on the surface of the film is the result of boiling water to make steam, it is a distillate. Therefore, it does not contain mineral deposits that would interfere with the intimate contact between the film and a playback head. Accordingly, letting the moisture evaporate does not appear to cause any problems when the film passes over a playback head. In addition, letting the moisture evaporate is preferred as it is believed that some of this moisture continues to be absorbed by the film while it is wound on the take-up reel, which aids in softening the film further.

Although the speed of the film through the chamber does not appear to be critical, increasing the film speed similarly increases the chance of misalignment between the film and the rollers or other mechanical problems. For example, as those skilled in the art recognize, if the softened film folds over on itself as it passes through the chamber due to misalignment with a roller, the film is almost invariably ruined and must be discarded. Therefore, slower speeds, preferably about 45 feet per minute or less, are preferred to minimize the risk of causing misalignment or other mechanical problems. The film speed is controlled by drive roller 36 on the mechanical film transporter 30. The drive roller 36 is driven at a constant speed by a motor (not shown) which can be any conventional motorized apparatus for transporting film.

The length of time that the film is in contact with the steam is preferably between about 10 to about 20 seconds, preferably about 15 seconds. Care must be taken with exposure times exceeding about 20 seconds, and particularly exposure times exceeding about 30 seconds, to ensure that the heat from the steam does not distort the film. Also, too much time in the steam may cause the acetate film to swell excessively and become "mushy." This swelling causes the film to expand beyond acceptable dimensional limits, which renders the film virtually worthless since it cannot be put through a sound transfer device. Consequently, the information recorded on a film that is exposed to the steam for too long is lost forever. To avoid destroying sound masters which are one-of-a-kind films, it is preferred to have the film pass through the chamber more than once, if necessary, keeping the time that the film is in contact with the steam to between about 10 to about 20 seconds for each pass. In addition, each subsequent pass through the chamber can be delayed for a predetermined period of time, even as much as a day, to allow moisture on the surface of the film to evaporate.

Because the acetate content in acetate-based films tends to vary from film to film, even among film stock made by the same manufacturer, and different films have been processed and stored under different conditions, the degree of deterioration from film to film varies widely and cannot be definitively ascertained merely by visually inspecting the film. Because there is no way of knowing in advance how any particular acetate-based film will react when placed in a hot or wet environment, the method of the present invention may affect different magnetic acetate-based films differently. For some films, a single pass through the chamber may be sufficient, with the treated film remaining in its flattened state for about one-half hour or more which allows sufficient time to reproduce the sound track. Other films may need two, three, or more passes through the chamber to achieve the same result, and may remain in the flattened state for more or less than 30 minutes. In sum, no two films appear to behave in exactly the same way, although it is believed that within a matter of days, all films return to the physical condition they were in before being treated by the process of the present invention.

After the film is removed from the chamber and the moisture on the surface of the film has evaporated, if the film is not sufficiently flat, it can be passed through the chamber again. On the other hand, if the film is now sufficiently flat so that it can conform to the surface of a playback head, it can be put through a sound transfer device. Because the industry standard for the speed of a film passing over a playback head is 90 feet per minute, film exiting the chamber at a speed of less than 90 feet per minute cannot pass directly through a sound transfer device. It is, however, within the scope of the present invention that film may pass through the chamber at 90 feet per minute so that it may pass through a sound transfer device, such as that shown in FIG. 1 at 38, before being rewound on take-up reel 24. The sound transfer device transfers the sound track to another, preferably more durable substrate, such as a polyester film, as is well known in the art. Suitable polyester films include Scotch brand 275 digital audio mastering tape and 340/341 magnetic film, both made by 3M. The information recorded on the film can also be transferred and stored in a computer memory if desired.

The chamber through which the film passes can be of any desired configuration and size. Ideally, the chamber will be sized to control the length of time that the film is in contact with the steam while limiting its volume to minimize the amount of steam needed. Although the chamber may be of any desired height and width, one preferred configuration is 72 inches by 13 inches. The chamber may be constructed out of any material, although a material that is rust and mildew resistant, such as aluminum, is preferred. Although the entire chamber may be constructed from the same material, preferably one of the sides of the chamber is transparent so that the operator can visually inspect the film as it passes through the chamber to minimize the chance that the film will be in contact with the steam for longer than necessary or that a misalignment problem will occur. Therefore, the chamber preferably has a plexiglass door 26. A seal 28 is preferably adhesively secured around the door frame to aid in keeping the steam inside the chamber. Any conventional foam sealing material, such as, e.g., one-quarter inch foam used around windows that can be purchased at any building supply store, may be used. The door may be secured by latch 34 using any standard latching mechanism known in the art that will press the door against the foam seal sufficiently to keep moisture inside the chamber. The film entrance and exit slot 20 provides a vent for the steam, and an opening on the order of 2 inches by 2 inches is believed to be adequate for this purpose.

The film rollers 22 in chamber 10 are of a construction well-known in the art, and may be of any suitable size and material. Plastic rollers having a three inch diameter, nylon shafts, and stainless steel bearings are preferred. The width of the rollers may dictate the depth of the chamber, e.g., if the rollers are 3 inches in width, the chamber need be only slightly more than 3 inches deep, preferably about $3\frac{1}{2}$ inches. The rollers must be unrelieved, that is, the surface of the roller over which the film passes must be flat so that the film conforms to this flat surface as it passes through the chamber. Preferred rollers can be purchased from Treise Engineering in Sun Valley, Calif. The rollers may be arranged within the chamber in any suitable number and arrangement to achieve the desired film residence time within the chamber. Thus, any combination of roller arrangement, together with the height and width of the chamber, may be used. It will also be appreciated that the more rollers that are used, the greater the chance of developing a mechanical problem or a misalignment problem as the film passes over and around the plurality of rollers before exiting the chamber. In addition, roller 32 before the film exits the chamber may be a conventional sprocket roller to help maintain the proper alignment of the film.

The location of the steam inlet does not appear to be critical, although introducing the steam through a nozzle located near to where the film enters the chamber may be beneficial. Any commercial vaporizer appears to be suitable for use in the present invention, and no special nozzles are required. Although more than one vaporizer may be utilized, a single vaporizer generally appears to be adequate. The size of the vaporizer is not thought to be of particular significance, although a vaporizer having a capacity of one gallon per 12 hours, such as the Hankscraft Model 5592D Vaporizer from Devilbiss Healthcare Inc., works well.

The method for treating a magnetic acetate-based film of the present invention provides a controlled environment for contacting the film with steam in a gentle and uniform manner, without the need to chemically treat the film. The particular advantage of the present invention is that control can be maintained over the length of time that the film is in contact with the steam. Moreover, steam appears to be more sensitive to the variances between different films. While it may be possible to achieve a satisfactory result by immersing an acetate-based film in a heated water bath, use of a water bath, besides being more cumbersome, appears to be far more risky than the method of the present invention.

This is primarily due to the fact that the length of time that the film can be immersed in the water bath before becoming mushy is very short, generally on the order of a few seconds. Because the film must be in and out of the water so quickly, there is insufficient time to determine whether or not the film has been immersed in the bath for a sufficient time. However, if one guesses wrong as to how long the film should be immersed, and the film becomes mushy, the film invariably has been ruined. Thus, a one-of-a-kind film will have to be discarded, and the information recorded on that film will have been lost forever.

While preferred embodiments and applications of this invention have been shown and described, it will be apparent to those skilled in the art that many more modifications are possible without departing from the inventive concept described herein. The invention, therefore, is to be limited only by the lawful scope of the claims which follow.

What is claimed is:

1. A method for treating a physically distorted magnetic acetate-based film onto which a sound track has been recorded, comprising:

placing the physically distorted film in a container and contacting the film with an effective amount of steam to soften the film so that the film becomes flatter.

2. The method of claim 1, wherein the film contacts the steam for between about 10 to about 20 seconds.

3. The method of claim 1, wherein the acetate-based film has a magnetic particle layer onto which a sound track has been recorded.

4. The method of claim 3, further comprising:

removing the film from the container; and passing the film over a playback head in a sound transfer device to reproduce the sound track.

5. A method for treating an acetate-based film having a magnetic particle layer onto which a sound track has been recorded so that the sound track can be reproduced, comprising:

placing the film in a container containing steam;

contacting the film with an effective amount of steam for a period of time sufficient to soften the film until the film becomes flatter; and removing the film from the container.

6. The method of claim 5, wherein the steam contacts the film for between about 10 to about 20 seconds.

7. The method of claim 5, wherein the steam contacts the film for about 15 seconds.

8. The method of claim 5, further comprising:

passing the treated film over a playback head in a sound transfer device to reproduce the sound track.

9. A method for treating an acetate-based film having a magnetic particle layer onto which a sound track has been recorded before reproducing the sound track, comprising:

introducing the film into a chamber suitable for filling with steam;

introducing steam into the chamber while the film is in the chamber;

contacting the film with the steam as the film passes through the chamber so that the film contacts an effective amount of steam for a period of time sufficient to soften the film so that the film becomes flatter; and removing the film from the chamber.

10. The method of claim 9, wherein the length of time that the film is in the chamber is from about 10 to about 20 seconds.

11. The method of claim 9, wherein the length of time that the film is in the chamber is about 15 seconds.

12. The method of claim 9, wherein the film passes through the chamber at a speed of about 45 feet per minute or less.

13. The method of claim 9, wherein the film passes through the chamber at a speed of about 90 feet per minute.

14. The method of claim 9, wherein after the film is removed from the chamber, the method further comprises:

passing the treated film over a playback head in a sound transfer device to reproduce the sound track.

15. The method of claim 14, wherein before the film passes over the playback head, at least 30 minutes have elapsed since the film was removed from the chamber.

16. The method of claim 9, wherein the film passes through the chamber at least twice.

17. The method of claim 14, wherein the sound track is transferred onto a polyester substrate.

18. A method for transferring a sound track from a magnetic acetate-based film, comprising:

passing the film through a chamber containing steam so that steam contacts the film long enough to soften the film, thereby making the film flatter; and transferring the sound track onto a polyester substrate by passing the film over a playback head in a sound transfer device.

19. The method of claim 18, wherein the film passes through the chamber at a speed of about 45 feet per minute or less.

20. The method of claim 18, wherein the film passes through the chamber at a speed of about 90 feet per minute.

21. The method of claim 18, wherein the film passes through the chamber at least twice.

22. The method of claim 18, wherein the steam contacts the film for about 10 to about 20 seconds.

* * * * *